US009335682B2

(12) United States Patent
Kurokawa

(10) Patent No.: US 9,335,682 B2
(45) Date of Patent: May 10, 2016

(54) IMAGE FORMING APPARATUS, TEMPERATURE CONTROL METHOD FOR USE IN FIXING DEVICE, AND NON-TRANSITORY RECORDING MEDIUM

(71) Applicant: KYOCERA Document Solutions Inc., Osaka-shi, Osaka (JP)

(72) Inventor: Yuichiro Kurokawa, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/552,198

(22) Filed: Nov. 24, 2014

(65) Prior Publication Data

US 2015/0147077 A1 May 28, 2015

(30) Foreign Application Priority Data

Nov. 26, 2013 (JP) ..... 2013-244440

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/70
See application file for complete search history.

(56) References Cited

U.S. PATENT DOCUMENTS 5,521,686 A 5/1996 Muto
2004/0136744 A1* 7/2004 Endo ..... G03G 15/205 399/70

FOREIGN PATENT DOCUMENTS

| | | | |
|---|---|---|---|
| JP | 07114292 | A | 5/1995 |
| JP | H11102140 | A | 4/1999 |
| JP | 2011107419 | A | 6/2011 |
| JP | 2012118409 | A | 6/2012 |

* cited by examiner

*Primary Examiner* — Walter L Lindsay, Jr.
*Assistant Examiner* — Ruth Labombard
(74) *Attorney, Agent, or Firm* — Alleman Hall McCoy Russell & Tuttle LLP

(57) ABSTRACT

An image forming apparatus includes a fixing device. The fixing device includes a fixing roller and a pressure roller. The fixing roller applies heat of a predetermined fixing temperature T1 to a print sheet S to which a toner image has been transferred. The pressure roller has a larger heat capacity than the fixing roller. A control portion of the image forming apparatus determines, in a power saving mode, whether or not a detection result of a temperature sensor is equal to or lower than a motor rotation start temperature T3 which is lower than the fixing temperature T1 (first step). Upon determining that the detection result is equal to or lower than the motor rotation start temperature T3, the control portion controls a driving motor to rotate the fixing roller at least once in the state where a halogen lamp has been lighted off (second step).

4 Claims, 8 Drawing Sheets

IMAGE FORMING APPARATUS, TEMPERATURE CONTROL METHOD FOR USE IN FIXING DEVICE, AND NON-TRANSITORY RECORDING MEDIUM

INCORPORATION BY REFERENCE

This application is based upon and claims the benefit of priority from the corresponding Japanese Patent Application No. 2013-244440 filed on Nov. 26, 2013, the entire contents of which are incorporated herein by reference.

BACKGROUND

The present disclosure relates to an image forming apparatus, a temperature control method for use in a fixing device, and a non-transitory computer-readable recording medium storing a program for controlling an image forming apparatus.

Conventionally, there have been known image forming apparatuses such as copiers, printers, facsimiles that operate based on the electrophotography. A typical image forming apparatus includes a fixing device. The fixing device applies a pressure onto a sheet on whose surface a toner image has been transferred, while applying heat thereto. This allows the toner image to be fixed to the sheet. A typical fixing device includes a pair of rotators, namely a fixing roller and a pressure roller. A heat source, such as a heater, is embedded in the fixing roller. The pressure roller is disposed to face the fixing roller, and the outer circumferential surface thereof is pressed against and contacted with the fixing roller.

The fixing device performs a temperature control to maintain the fixing roller at a predetermined fixing temperature to maintain a fixable state during an image forming period. The power consumption for heating the fixing device accounts for 70% to 80% of the power consumption of the image forming apparatus. To attain the power saving by reducing the power consumption of the image forming apparatus, the fixing device, during an image non-forming period, performs the temperature control to maintain the fixing roller at a wait temperature, which is lower than the fixing temperature. Specifically, during the temperature control, when the fixing roller becomes lower than the wait temperature, the heat source is operated to heat it, and when the fixing roller becomes equal to or higher than the wait temperature, the heat source is stopped to stop heating. It is noted that the wait temperature is a temperature arbitrarily set in a range from a temperature during a non-heating period to the fixing temperature. For example, the wait temperature is set to such a temperature of the fixing roller that can quickly be raised to the fixing temperature for the image formation by operating the heat source in response to an input of an image forming instruction.

In addition, to attain the power saving, when image data for printing is not input to the image forming apparatus during a predetermined time period, the fixing device performs a temperature control to change the temperature of the fixing roller from the fixing temperature to the wait temperature. As a technology related to the temperature control, there is known, for example, a technology to reduce the time required to start printing the first sheet, by changing the temperature of the fixing roller from the wait temperature to the fixing temperature while scanning the image data on the photoconductor drum during returning from the wait state. As another technology related to the temperature control, there is known, for example, a technology to determine whether or not an initialization process is necessary immediately after the apparatus is powered on, and upon determining that the initialization process is necessary, warm up the fixing device.

SUMMARY

An image forming apparatus according to an aspect of the present disclosure includes a heat conductor, a heating portion, a pressure roller, a driving portion, a temperature detecting portion, a first temperature control portion, and a second temperature control portion. The heat conductor is rotatably supported and configured to conduct heat to a sheet to which a toner image has been transferred. The heating portion is configured to heat the heat conductor. The pressure roller is formed from a material having a larger heat capacity than the heat conductor, and is configured to form a pressure contact portion by pressing and contacting the heat conductor and apply a pressure onto a sheet that passes through the pressure contact portion. The driving portion is configured to rotate either or both of the heat conductor and the pressure roller. The temperature detecting portion is configured to detect a surface temperature of the heat conductor. The first temperature control portion is configured to control temperature of the heat conductor in an image forming mode or a power saving mode. In the image forming mode, the first temperature control portion controls, during an image forming period, the heating portion to maintain the heat conductor at a first temperature at which the toner image can be fixed to the sheet. In the power saving mode, the first temperature control portion controls, during an image non-forming period, the heating portion to maintain the heat conductor at a second temperature which is lower than the first temperature. The second temperature control portion is configured to, upon determining that the temperature detected by the temperature detecting portion is equal to or lower than a third temperature when the first temperature control portion shifts from the image forming mode to the power saving mode, cause the driving portion to rotate the heat conductor at least once in a state where the heating portion has been stopped, the third temperature being set in advance in a range from being lower than the first temperature to being equal to or higher than the second temperature.

A temperature control method according to another aspect of the present disclosure includes a first step and a second step, the temperature control method being for use in a fixing device which includes a heat conductor and a pressure roller. The heat conductor is heated by a heating portion and is rotatably supported and configured to conduct heat to a sheet to which a toner image has been transferred. The pressure roller is formed from a material having a larger heat capacity than the heat conductor and is configured to form a pressure contact portion by pressing and contacting the heat conductor and apply a pressure onto a sheet that passes through the pressure contact portion. The first step, after an image forming mode has shifted to a power saving mode, determines whether or not a temperature detected by a temperature detecting portion is equal to or lower than a third temperature. In the image forming mode, the heat conductor is maintained at a first temperature at which the toner image can be fixed to the sheet. In the power saving mode, the heat conductor is maintained at a second temperature which is lower than the first temperature. The temperature detecting portion is configured to detect a surface temperature of the heat conductor. The third temperature is set in advance in a range from being lower than the first temperature to being equal to or higher than the second temperature. The second step, when the first step determines that the temperature detected by the temperature detecting portion is equal to or lower than the third temperature, rotates the heat conductor at least once in a state where the heating portion has been stopped.

A recording medium according to a further aspect of the present disclosure is a non-transitory computer-readable recording medium for controlling an image forming apparatus. The image forming apparatus includes a heat conductor, a pressure roller, a driving portion, and a temperature detecting portion. The heat conductor is heated by a heating portion, rotatably supported and configured to conduct heat to a sheet to which a toner image has been transferred. The pressure roller is formed from a material having a larger heat capacity than the heat conductor and is configured to form a pressure contact portion by pressing and contacting the heat conductor and apply a pressure onto a sheet that passes through the pressure contact portion. The driving portion is configured to rotate either or both of the heat conductor and the pressure roller. The temperature detecting portion is configured to detect a surface temperature of the heat conductor. The recording medium stores a program for causing a computer to execute a first step and a second step. The first step, after an image forming mode has shifted to a power saving mode, determines whether or not a temperature detected by the temperature detecting portion is equal to or lower than a third temperature. In the image forming mode, the heat conductor is maintained at a first temperature at which the toner image can be fixed to the sheet. In the power saving mode, the heat conductor is maintained at a second temperature which is lower than the first temperature. The third temperature is set in advance in a range from being lower than the first temperature to being equal to or higher than the second temperature. The second step, when the first step determines that the temperature detected by the temperature detecting portion is equal to or lower than the third temperature, causes the driving portion to rotate the heat conductor at least once in a state where the heating portion has been stopped.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments

Figure 1:
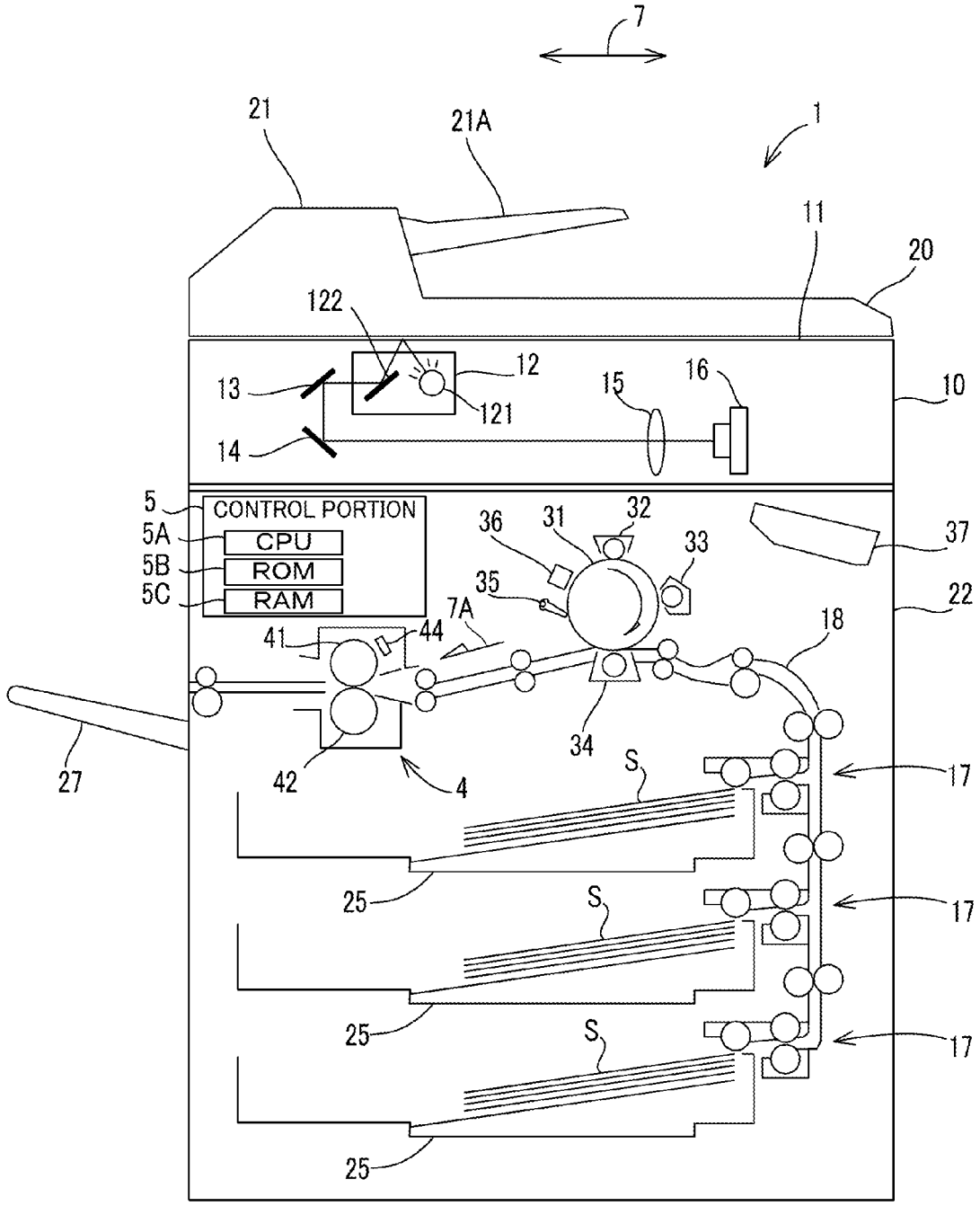
FIG. 1 is a diagram showing the configuration of the image forming apparatus in an embodiment of the present disclosure.

The following describes embodiments of the present disclosure with reference to the drawings as appropriate. It should be noted that the following embodiments are examples of specific embodiments of the present disclosure and should not limit the technical scope of the present disclosure.

[Outlined Configuration of Image Forming Apparatus 1]

First, an outlined configuration of an image forming apparatus 1 in an embodiment of the present disclosure is described with reference to FIG. 1.

The image forming apparatus 1 is a multifunction peripheral having functions of a printer, a copier, a facsimile and the like. The image forming apparatus 1 prints an image onto a print sheet S (an example of the sheet) by using developer such as toner, based on input image data. The image forming apparatus 1 includes an image reading portion 10 for reading an image from a document sheet, and an image forming portion 22 for forming an image based on the electrophotography. The image reading portion 10 is provided in an upper part of the image forming apparatus 1, and the image forming portion 22 is provided in a lower part of the image forming apparatus 1. It is noted that although in the present embodiment, the image forming apparatus 1 is explained as an example of the image forming apparatus of the present disclosure, the image forming apparatus of the present disclosure is not limited to the image forming apparatus 1, but may be, for example, a printer, a facsimile apparatus, a copier, or the like.

[Image Reading Portion 10]

The image reading portion 10 includes a contact glass 11 and a document sheet cover 20, wherein the contact glass 11 serves as the document sheet mounting surface, and the document sheet cover 20 is opened and closed with respect to the contact glass 11. When the image forming apparatus 1 functions as a copier, the image reading portion 10 reads an image as follows. That is, after a document sheet is placed on the contact glass 11 and the document sheet cover 20 is closed, upon receiving a copy start instruction input from an operation display panel (not shown), the image reading portion 10 starts the reading operation and reads the image data of the document sheet. The image reading portion 10 includes optical equipments such as a reading unit 12, a mirror 13, a mirror 14, an optical lens 15, a CCD 16, and the like. The reading unit 12 includes an LED light source 121 and a mirror 122. The reading unit 12 is moved in a sub scanning direction 7 by a motor or the like. During the move, light is irradiated from the LED light source 121 toward the contact glass 11, and the light is scanned in the sub scanning direction 7. The reflection light thereof is input to the CCD 16 via the mirror 122 and the like. This allows an image to be read from the document sheet placed on the contact glass 11.

The document sheet cover 20 includes an ADF 21. The ADF 21 feeds, one by one, a plurality of document sheets set in a document sheet setting portion 21A, by using a plurality of feeding rollers (not shown). The ADF 21 allows the document sheet to pass a reading position provided on the contact glass 11, by moving it rightward in the sub scanning direction 7. In the case where the document sheet is moved by the ADF 21, the image of the moving document sheet is read by the reading unit 12 that is disposed below the reading position.

[Image Forming Portion 22]

The image forming portion 22 executes an image forming process (print process) based on image data read by the image reading portion 10, or based on image data input from an external information processing apparatus. The image forming portion 22 operates based on the electrophotography. As shown in FIG. 1, the image forming portion 22 includes sheet feed cassettes 25, a photoconductor drum 31, a charging device 32, a developing device 33, a transfer device 34, a cleaning blade 35, an electricity removing device 36, a fixing device 4, an exposure device 37, a paper sheet discharge portion 27, and the like.

As shown in FIG. 1, the sheet feed cassettes 25 are provided below the image forming portion 22. In the present embodiment, three sheet feed cassettes 25 are arranged along the up-down direction. Each sheet feed cassette 25 stores a plurality of print sheets S (sheets) in a stacked state. The print sheets S stored in the sheet feed cassettes 25 are picked up one by one by a conveying mechanism 17 that includes conveying rollers and the like. The picked-up print sheet S is then conveyed in a conveyance path 18 provided inside the image forming portion 22, toward the transfer device 34.

The photoconductor drum 31 is a rotator formed in the shape of a drum, and is rotatably supported by a frame or the like inside the image forming portion 22. Upon receiving a driving force transmitted from a driving source such as a motor or the like (not shown), the photoconductor drum 31 is driven to rotate in a clockwise rotation direction in FIG. 1.

The charging device 32, developing device 33, transfer device 34, cleaning blade 35, electricity removing device 36 are disposed along the outer circumferential surface of the photoconductor drum 31.

The charging device 32 is provided above the photoconductor drum 31 to face the outer circumferential surface of the photoconductor drum 31. When forming an image, the charging device 32 charges a photosensitive layer on the outer circumferential surface of the photoconductor drum 31, uniformly into a certain surface potential. The developing device 33 is provided on the downstream side of the charging device 32 in the rotation direction of the photoconductor drum 31. The developing device 33 includes a developing roller to which a bias voltage lower than the surface potential is applied. Toner is supplied from a toner container (not shown) to the photoconductor drum 31 by the developing roller.

The exposure device 37 irradiates a laser beam from between the charging device 32 and the developing device 33 toward the photoconductor drum 31, thereby exposing the outer circumferential surface of the photoconductor drum 31. This allows an electrostatic latent image to be formed on the outer circumferential surface of the photoconductor drum 31, based on the image information contained in the laser beam. That is, when the outer circumferential surface of the photoconductor drum 31 is irradiated with a laser beam, the part exposed to the laser beam is decreased in potential, and the exposed part becomes the electrostatic latent image. Subsequently, when the developing device 33 supplies toner to the photoconductor drum 31, the toner adheres to the electrostatic latent image by the electrostatic force generated by the potential difference between the electrostatic latent image and the bias voltage, thereby a toner image is formed on the outer circumferential surface of the photoconductor drum 31.

The transfer device 34 is provided on the downstream side of the developing device 33 in the rotation direction of the photoconductor drum 31. The transfer device 34 is provided below the photoconductor drum 31 to face the outer circumferential surface of the photoconductor drum 31. The transfer device 34 includes a transfer roller that contacts and rotates with the outer circumferential surface of the photoconductor drum 31. During the image forming process, the print sheet S is nipped, at a nip portion, between the photoconductor drum 31 and the transfer roller, and in that state, a toner image formed on the outer circumferential surface of the photoconductor drum 31 is adhered (transferred) to a surface of the print sheet S.

The cleaning blade 35 is provided on the downstream side of the transfer device 34 in the rotation direction of the photoconductor drum 31. The cleaning blade 35 removes toner that has not been transferred and remained on the outer circumferential surface of the photoconductor drum 31, and is made of silicone rubber or the like.

The electricity removing device 36 is provided on the downstream side of the cleaning blade 35 in the rotation direction of the photoconductor drum 31. The electricity removing device 36 removes charges that have remained on the photosensitive layer of the photoconductor drum 31.

[Fixing Device 4]

Figure 2:
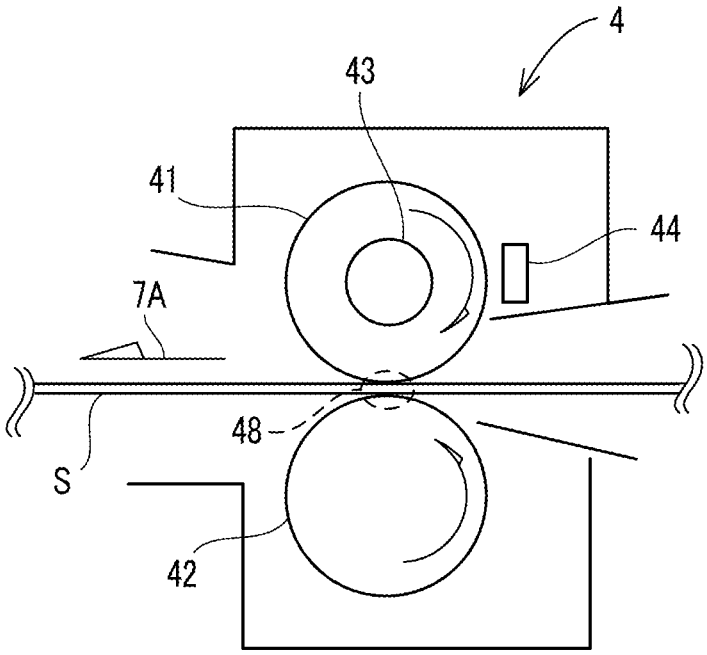
FIG. 2 is a diagram showing the configuration of the fixing device included in the image forming apparatus.
Figure 3:
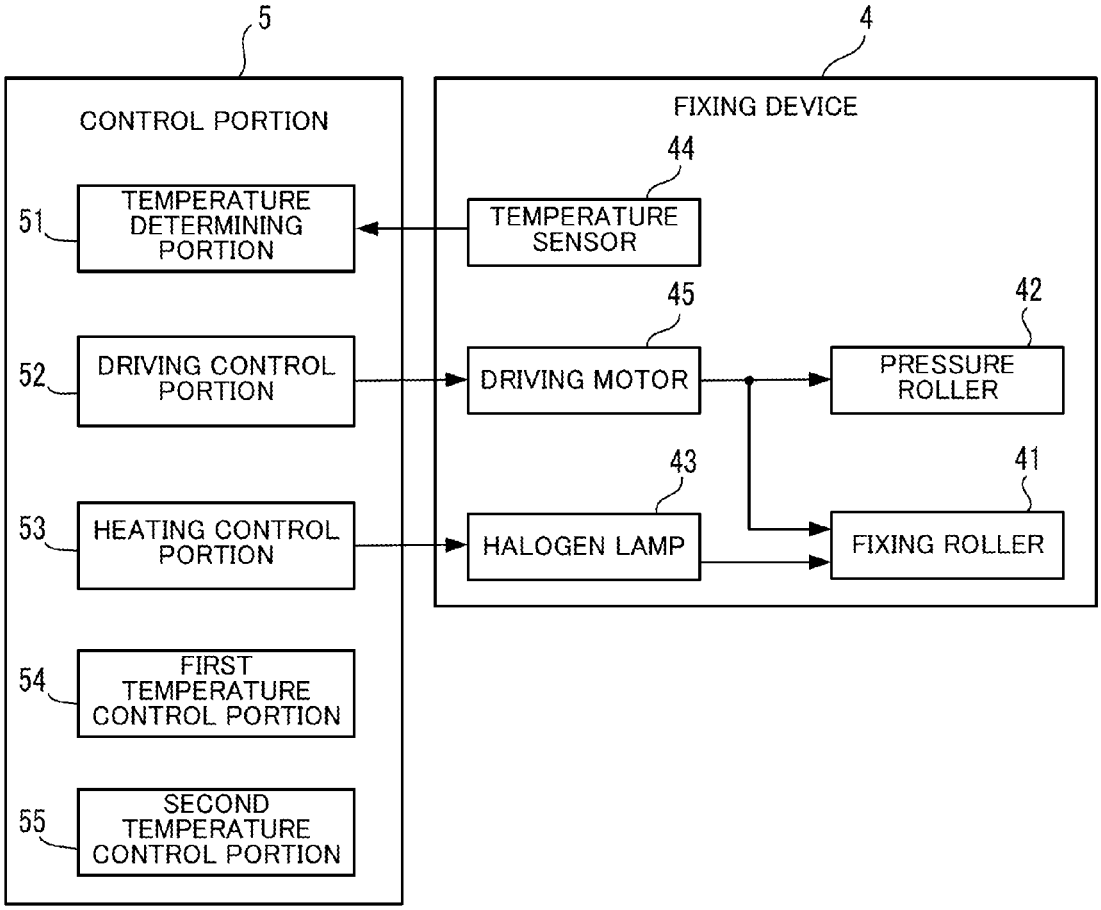
FIG. 3 is a block diagram showing the configuration of the control system included in the image forming apparatus.

As shown in FIG. 1, the fixing device 4 is provided on the downstream side of the transfer device 34 in a conveyance direction 7A of the print sheet S. The fixing device 4 fixes the toner image, which has been transferred to a print sheet S, to the print sheet S. After passing through the fixing device 4, the print sheet S is discharged into the paper sheet discharge portion 27. As shown in FIGS. 2 and 3, the fixing device 4 includes a fixing roller 41 (an example of the heat conductor), a pressure roller 42 (an example of the pressure roller), a temperature sensor 44 (an example of the temperature detecting portion), a driving motor 45 (an example of the driving portion), and the like.

The fixing roller 41, rotatably supported, conducts heat to the print sheet S to which the toner image has been transferred. The fixing roller 41 is formed into a roller shape from a metal such as stainless steel having a cylindrical shape. As a result, the fixing roller 41 has a small heat capacity, and its temperature can be raised in a relatively short time.

A halogen lamp 43 (an example of the heating portion) is provided in the fixing roller 41, and heats the fixing roller 41 from inside. The halogen lamp 43 uses a heating resistor such as tungsten to heat the fixing roller 41 from inside. When the halogen lamp 43 is lighted on (operated), it heats the fixing roller 41; and when the halogen lamp 43 is lighted off (in the non-operation state, or stopped), it does not heat the fixing roller 41. When the halogen lamp 43 is lighted off and the transmission of heat is stopped, the fixing roller 41 is deprived of heat by the ambient air, and is gradually cooled to a room temperature. It is noted that, not limited to the halogen lamp 43, but a ceramic heater or the like may be applied to the heating portion.

The pressure roller 42 is disposed to face the fixing roller 41, and is press-contacted with the fixing roller 41. At a fixing nip portion 48 which is a pressure contact portion formed between the fixing roller 41 and the pressure roller 42, the pressure roller 42 applies a pressure onto the print sheet S such that the toner image is fixed to the print sheet S. The pressure roller 42 includes: a cylindrical metal core made of a metal such as stainless steel; an elastic layer formed on the metal core and made of, for example, a silicone resin; and a releasing layer that covers the surface of the elastic layer and is made of, for example, a fluororesin. With this configuration, the pressure roller 42 can provide an appropriate nip width and apply an appropriate pressure to the print sheet S. In addition, the pressure roller 42 is formed from a material having a large heat capacity, such as a silicone resin. As a result, the pressure roller 42 holds more heat than the fixing roller 41, which is formed from a metal or the like.

The driving motor 45 causes the pressure roller 42 to rotate by applying a driving force thereto. The fixing roller 41 is rotated by receiving a driving force from the pressure roller 42 that press-contacts the fixing roller 41 at the fixing nip portion 48. It is noted that the driving motor 45 may cause the fixing roller 41 to rotate by applying a driving force thereto, causing the pressure roller 42 to be rotated by receiving a driving force from the fixing roller 41. Alternatively, the driving motor 45 may apply driving forces to both the fixing roller 41 and the pressure roller 42 so that they are both rotated.

The temperature sensor 44 detects the surface temperature of the fixing roller 41. The temperature sensor 44 outputs the detected temperature (detection result) to the control portion 5. The temperature sensor 44 is, for example, an NTC thermistor whose resistance proportionally decreases with the rise in temperature. The detecting portion of the temperature sensor 44 is disposed on the upstream side in the conveyance direction 7A in which the fixing roller 41 conveys the print sheet S.

[Configuration of Control Portion 5]

The control portion 5 comprehensively controls the image forming apparatus 1. As shown in FIG. 1, the control portion 5 is configured as a microcomputer that includes, as the main component elements, a CPU 5A, a ROM 5B, and a RAM 5C. It is noted that the control portion 5 may be configured as an electronic circuit such as an integrated circuit (ASIC, DSP) or the like.

The control portion 5 is connected, in the image forming apparatus 1, to the image reading portion 10, ADF 21, image forming portion 22, conveying mechanism 17, and the like, and controls these component elements. In addition, as shown in FIG. 3, the control portion 5 is also connected to the elements constituting the fixing device 4 included in the image forming portion 22. Specifically, the control portion 5 is connected to the temperature sensor 44, driving motor 45, halogen lamp 43, and the like. The ROM 5B stores a program for executing the image forming process. The CPU 5A controls the elements connected thereto and prints an image on a print sheet S, by executing the program stored in the ROM 5B.

In the present embodiment, the ROM 5B of the control portion 5 stores a program and the like for executing a temperature control process that is described below. The ROM 5B is an example of the recording medium. The CPU 5A executes the temperature control process by reading the program from the ROM 5B and executing the program. In addition, when the CPU 5A executes the program, the control portion 5 functions as a temperature determining portion 51, a driving control portion 52, a heating control portion 53, a first temperature control portion 54 (an example of the first temperature control portion), and a second temperature control portion 55 (an example of the second temperature control portion) (see FIG. 3), during the temperature control process.

In addition, the ROM 5B stores not only the program, but also temperature values, rotation time periods and the like that are used in the temperature control process. For example, the ROM 5B stores setting values such as a fixing temperature T1 (an example of the first temperature), a wait temperature T2 (an example of the second temperature), a motor rotation start temperature T3 (an example of the third temperature), and the like that are a comparison target for the temperature determining portion 51. It is noted that the fixing temperature T1 is a temperature at which the toner image can be fixed to the print sheet S, and is in a range from 180° C. to 200° C., for example. The wait temperature T2 is a temperature based on which the temperature control is performed during the image non-forming period. The wait temperature T2 is a temperature arbitrarily set in a range from a temperature during the non-heating period to the fixing temperature T1. The wait temperature T2 is set as a temperature of the fixing roller 41 that can quickly be raised to the fixing temperature T1 for image formation by operating the halogen lamp 43 when an image forming instruction or the like is input, and is 50° C., for example. The motor rotation start temperature T3 is set, in advance, in a range from being lower than the fixing temperature T1 to being equal to or higher than the wait temperature T2, and is 51° C., for example. In addition, the ROM 5B stores setting values of a conductive time period that is necessary for the driving control portion 52 to drive the fixing roller 41 and the pressure roller 42 to rotate, and the like. The ROM 5B also stores setting values of a lighting-on time period for which the heating control portion 53 lights on the halogen lamp 43. It is noted that the RAM 5C temporarily stores the temperature determined by the temperature determining portion 51, the operation time period for which the driving control portion 52 operates, the lighting-on time period for which the heating control portion 53 lights on the halogen lamp 43, and the like.

The temperature determining portion 51 compares the temperature detected by the temperature sensor 44, with the fixing temperature T1, wait temperature T2, and motor rotation start temperature T3 to determine whether the detected temperature is higher or lower than the fixing temperature T1, wait temperature T2, and motor rotation start temperature T3. It is noted that a specific example of the temperature determination performed by the temperature determining portion 51 is described below.

The driving control portion 52 rotates or stops the fixing roller 41 and the pressure roller 42. Upon determining that the determination result of the temperature determining portion 51 has become equal to or lower than the motor rotation start temperature T3, the driving control portion 52 rotates the fixing roller 41 at least once. The number of times and the time period for which the driving control portion 52 rotates the fixing roller 41 and the pressure roller 42 may be determined in advance. It is noted that a specific example of the drive control performed by the driving control portion 52 is described below.

When the temperature determining portion 51 determines that the temperature detected by the temperature sensor 44 is equal to or higher than the wait temperature T2, the heating control portion 53 lights off the halogen lamp 43. When the temperature determining portion 51 determines that the temperature detected by the temperature sensor 44 is lower than the wait temperature T2, the heating control portion 53 lights on the halogen lamp 43 and performs a control so that the temperature of the fixing roller 41 does not become lower than the wait temperature T2. It is noted that a specific example of the heating control performed by the heating control portion 53 is described below.

The first temperature control portion 54 executes an image forming mode. The image forming mode is an operation mode that causes the heating control portion 53 to control the lighting on and off of the halogen lamp 43 so that, during an image forming period, the fixing roller 41 is maintained at the fixing temperature T1. In addition, the first temperature control portion 54 executes a power saving mode. The power saving mode is an operation mode that causes the heating control portion 53 to control the lighting on and off of the halogen lamp 43 so that, during an image non-forming period, the fixing roller 41 is maintained at the wait temperature T2. The first temperature control portion 54 controls the temperature of the fixing device 4 in either of the image forming mode and the power saving mode.

When the temperature determining portion 51 determines that the temperature detected by the temperature sensor 44 is equal to or lower than the motor rotation start temperature T3 after the first temperature control portion 54 has shifted from the image forming mode to the power saving mode, the second temperature control portion 55 controls the driving control portion 52 to cause the driving motor 45 to rotate the fixing roller 41 at least once. During the at least one rotation, the heating control portion 53 maintains the state where the halogen lamp 43 has been lighted off (stopped). In addition, when the temperature determining portion 51 determines that the temperature detected by the temperature sensor 44 is not lower than (is equal to or higher than) the wait temperature T2 after the driving control portion 52 causes the driving motor 45 to rotate the fixing roller 41 at least once, the second temperature control portion 55 controls the driving control portion 52 to stop the driving motor 45 to rotate. It is noted that a specific example of the temperature control performed by the second temperature control portion 55 is described below.

Meanwhile, when an image forming instruction is input to the image forming apparatus 1, the fixing device 4 needs to shift, in a short time, from the power saving mode to the image forming mode where printing is possible. As a result, the fixing roller 41 is formed from a metal or the like having a small heat capacity so that it can be quickly raised from the wait temperature T2 to the fixing temperature T1. On the other hand, the pressure roller 42 is formed from an elastic silicone resin or the like so that it can provide an appropriate nip width and apply an appropriate pressure to the sheet. In general, a silicone resin or the like has a larger heat capacity than a metal. In the fixing device 4 as such, even if the temperature of the fixing roller 41 becomes lower than the wait temperature T2, the temperature of the pressure roller 42 may be higher than the wait temperature T2. In that case, when the temperature control is performed in the power saving mode so that the fixing roller 41 is maintained at the wait temperature T2, the fixing roller 41 is warmed not only by the heating performed by the halogen lamp 43 that is the heat source, but also by the heat conducted from the rotating pressure roller 42 via the fixing nip portion 48. In that case, an amount of heat, which is necessary for the fixing roller 41 to reach the wait temperature T2, may be obtained from the rotating pressure roller 42. This means that the heating by the halogen lamp 43 is wasted, and the image forming apparatus 1 consumes power wastefully. In view of this, in the present embodiment, to restrict wasteful power consumption during the temperature control to maintain the fixing roller 41 at the wait temperature T2, the control portion 5 executes the temperature control process as follows.

[Temperature Control Process]

Figure 4:
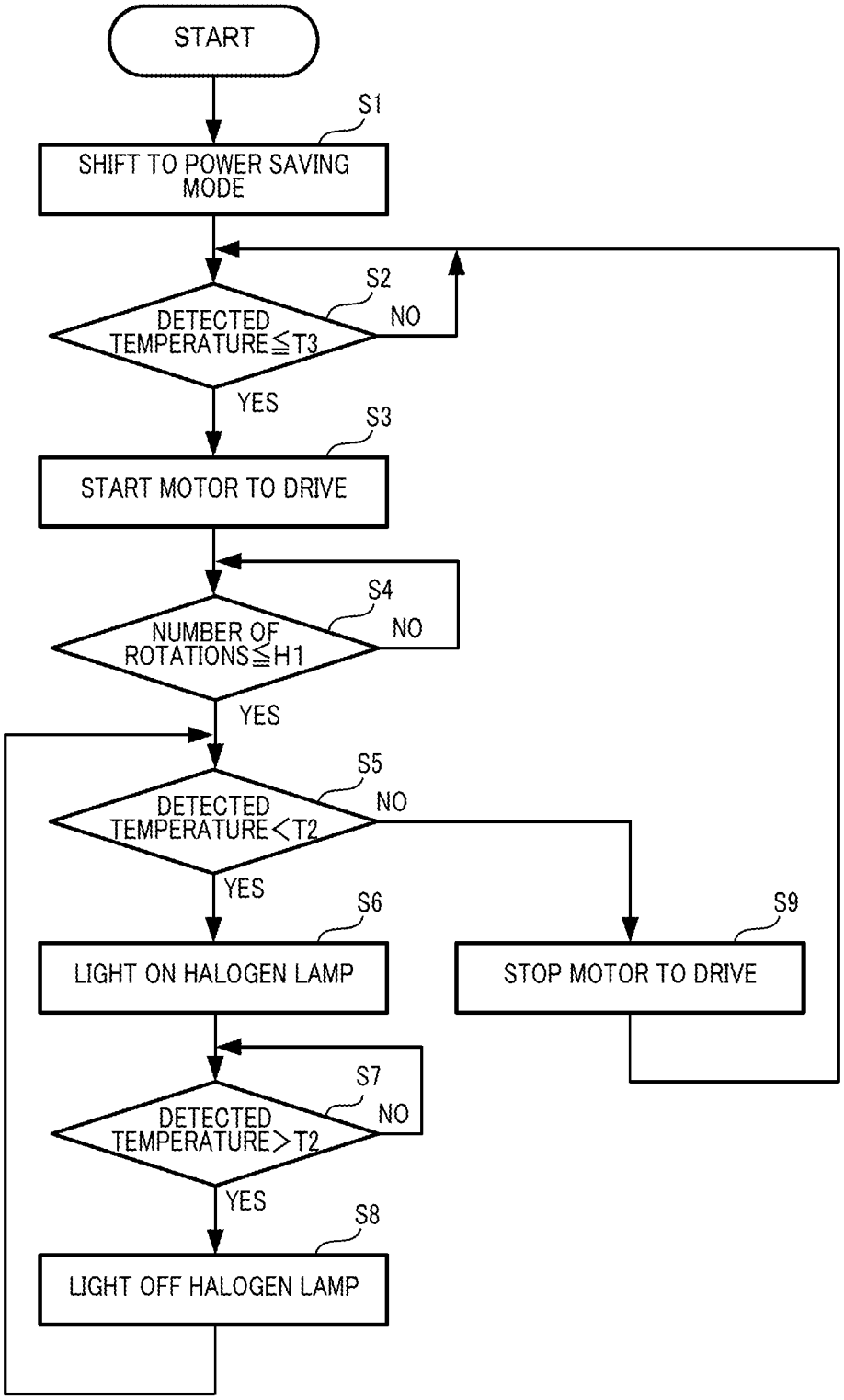
FIG. 4 is a flowchart showing the procedure of the temperature control process executed by the temperature control portion.

Next, a description is given of the procedure of the temperature control process executed by the control portion 5, as well as the temperature control method for use in a fixing device, and the program of the present disclosure, with reference to the flowchart of FIG. 4. Here, S1, S2, . . . represent the processing procedures (steps). The process in each step is executed by the control portion 5, more specifically each step is executed as the CPU 5A executes the program stored in the ROM 5B. When the control portion 5 executes the temperature control process, the control portion 5 functions as the second temperature control portion 55 of the present disclosure.

In the following description, it is supposed that, at step S1, the image forming apparatus 1 shifts from the image forming mode, where printing is possible, to the power saving mode. In other words, it is supposed that the image forming apparatus 1 shifts from the image forming mode to the power saving mode because none of a fax transmission/reception, a printing from a personal computer, a copy, and the like was performed during a predetermined power saving mode shifting time. It is noted that, when an image forming instruction is input while the control portion 5 is executing the temperature control process, the control portion 5 interrupts the temperature control process, and controls the image forming apparatus 1 to shift from the power saving mode to the image forming mode.

(Step 1)

First, in step S1, the control portion 5 shifts the operation mode of the image forming apparatus 1 from the image forming mode to the power saving mode since, during the predetermined power saving mode shifting time, no image forming instruction was input to the image forming apparatus 1. The control portion 5 lights off the halogen lamp 43, and stops the driving motor 45 to rotate the fixing roller 41 and the pressure roller 42. This causes the surface temperature of the fixing roller 41 to be fallen gradually from the fixing temperature T1.

(Step S2)

In step S2, the control portion 5 obtains the surface temperature of the fixing roller 41 detected by the temperature sensor 44, and determines whether or not the obtained surface temperature of the fixing roller 41 is equal to or lower than the motor rotation start temperature T3. In step S2, the control portion 5 waits until the surface temperature of the fixing roller 41 becomes equal to or lower than the motor rotation start temperature T3 (NO side at S2). On the other hand, upon determining that the surface temperature of the fixing roller 41 has become equal to or lower than the motor rotation start temperature T3 (YES side at S2), the control portion 5 moves the process to step S3. Here, steps S1 and S2 are an example of the first step of the present disclosure.

(Step S3)

In step S3, the control portion 5 drives the driving motor 45 to rotate the fixing roller 41 and the pressure roller 42. Since the fixing roller 41 is smaller than the pressure roller 42 in heat capacity, the surface temperature of the fixing roller 41 falls faster than the surface temperature of the pressure roller 42 during a predetermined time period after the shift to the power saving mode. Although there is a case where the surface temperature of the fixing roller 41 is lower than the motor rotation start temperature T3, the surface temperature of the pressure roller 42 may be higher than the motor rotation start temperature T3. As a result, when the fixing roller 41 is rotated at least once, heat is conducted from the pressure roller 42, which is press-contacting at the fixing nip portion 48, to the fixing roller 41. This allows the temperature of the whole outer circumferential surface of the fixing roller 41 to be raised. It is noted that, when step S3 is executed, the control portion 5 continues to light off the halogen lamp 43.

(Step S4)

In step S4, the control portion 5 determines whether or not the number of rotations of the fixing roller 41 that has been rotated by the driving motor 45 has reached a predetermined set rotation number H1. In step S4, the control portion 5 waits until the number of rotations of the fixing roller 41 reaches the set rotation number H1 (NO side at S4). On the other hand, upon determining that the number of rotations of the fixing roller 41 has reached the set rotation number H1 (YES side at S4), the control portion 5 moves the process to step S5. It is noted that the set rotation number H1 is the number of rotations which is required to conduct heat from the pressure roller 42 to the fixing roller 41, and is determined in advance based on the material quality, thickness, size, rotation speed or the like of the fixing roller 41 and the pressure roller 42. The set rotation number H1 may be set such that the fixing roller 41 continues to be rotated until it is stopped in step S9 as described below, as far as it is set that the fixing roller 41 is rotated at least once. Here, steps S3 and S4 are an example of the second step of the present disclosure.

(Step S5)

In step S5, the control portion 5 obtains the surface temperature of the fixing roller 41 detected by the temperature sensor 44, and determines whether or not the obtained surface temperature of the fixing roller 41 is lower than the wait temperature T2. Upon determining, in step S5, that the surface temperature of the fixing roller 41 is equal to or higher than the wait temperature T2 (NO side at S5), the control portion 5 moves the process to step S9. On the other hand, upon determining that the surface temperature of the fixing roller 41 is lower than the wait temperature T2 (YES side at S5), the control portion 5 moves the process to step S6.

(Step S6)

In step S6, the control portion 5 lights on the halogen lamp 43. In the above step S3, the control portion 5 has driven the driving motor 45 to rotate the fixing roller 41 and the pressure roller 42. As a result, the heat irradiated from the halogen lamp 43 is conducted equally to the surface of the fixing roller 41 and then to the pressure roller 42 via the fixing nip portion 48.

(Step S7)

In step S7, the control portion 5 obtains the surface temperature of the fixing roller 41 detected by the temperature sensor 44, and determines whether or not the obtained surface temperature of the fixing roller 41 is higher than the wait temperature T2. In step S7, the control portion 5 waits until the surface temperature of the fixing roller 41 becomes higher than the wait temperature T2 (NO side at S7). On the other hand, upon determining that the surface temperature of the fixing roller 41 has become higher than the wait temperature T2 (YES side at S7), the control portion 5 moves the process to step S8. This allows the control portion 5 to prevent the surface temperature of the fixing roller 41 from becoming lower than the wait temperature T2 and maintain the state where the image forming apparatus 1 can shift immediately from the power saving mode to the image forming mode in response to an input of an image forming instruction.

(Step S8)

In step S8, the control portion 5 lights off the halogen lamp 43. The control portion 5 prevents the surface temperature of the fixing roller 41 from becoming higher than the wait temperature T2, thereby preventing an excess power from being consumed to maintain the surface temperature of the fixing roller 41. After executing step S8, the control portion 5 moves the process to step S5. It is noted that when the process moves to step S5 via step S8, the control portion 5 determines in step S5 that the surface temperature of the fixing roller 41 is equal to or higher than the wait temperature T2 (NO side at S5), and thus moves the process from step S5 to step S9.

(Step S9)

Upon determining that the surface temperature of the fixing roller 41 is equal to or higher than the wait temperature T2 (NO side at S5), the process moves to step S9 in which the control portion 5 stops the driving motor 45 to drive. With this stop, the fixing roller 41 and the pressure roller 42 are stopped being rotated. In this case, since the surface temperature of the fixing roller 41 is equal to or higher than the wait temperature T2, the control portion 5 does not need to rotate the fixing roller 41 and the pressure roller 42. To suppress the power consumption of the image forming apparatus 1, the control portion 5 stops driving and rotating the fixing roller 41 and the pressure roller 42. After executing step S9, the control portion 5 moves the process to step S2.

The control portion 5 repeatedly executes processes of steps S2 through S9 until an image forming instruction is input. By executing, among the processes of steps S2 through S9, the processes of steps S2, S3, S4, S5 and S9, the control portion 5 functions as the second temperature control portion 55. In these processes, the control portion 5 causes the driving motor 45 to rotate the fixing roller 41 and the pressure roller 42 without lighting on the halogen lamp 43, thereby extending the time until the surface temperature of the fixing roller 41 falls to the wait temperature T2.

As described above, according to the present embodiment, during the temperature control process performed by the control portion 5, there is a case where the surface temperature of the fixing roller 41 is lower than the motor rotation start temperature T3, but the surface temperature of the pressure roller 42 is higher than the motor rotation start temperature T3. In that case, the control portion 5 controls the driving motor 45 to rotate the fixing roller 41 at least once, which allows heat to be conducted from the pressure roller 42 to the fixing roller 41, and the surface temperature of the fixing roller 41 is raised. This enables the control portion 5 to extend the time until the surface temperature of the fixing roller 41 falls to the wait temperature T2, without consuming the power by lighting on the halogen lamp 43.

Similarly, during the temperature control process performed by the control portion 5, there is a case where the surface temperature of the fixing roller 41 is lower than the wait temperature T2, but the surface temperature of the pressure roller 42 is higher than the wait temperature T2. In that case, when the control portion 5 controls the driving motor 45 to rotate the fixing roller 41 at least once, heat is conducted from the pressure roller 42 to the fixing roller 41, and the surface temperature of the fixing roller 41 is raised. This enables the control portion 5 to maintain the surface temperature of the fixing roller 41 to be equal to or higher than the wait temperature T2, without consuming the power by lighting on the halogen lamp 43.

[Other Embodiments of Temperature Control Process]

The above embodiment explains an example case where, on condition that the temperature detected by the temperature sensor 44 is equal to or higher than the wait temperature T2, the control portion 5 stops the driving motor 45 to rotate. However, the temperature control process is not limited to the above-described example. For example, as another embodiment of the temperature control process, the control portion 5 may stop the driving motor 45 to rotate when the temperature detected by the temperature sensor 44 reaches a predetermined motor stop temperature T4 (an example of the fourth temperature).

The other embodiment, different from the above-described embodiment, requires a process in which the control portion 5 determines whether or not the temperature detected by the temperature sensor 44 is equal to or higher than the motor stop temperature T4. Otherwise, the other embodiment has the same configurations and processes as the above-described embodiment. As a result, in the following, only parts that are different from the above-described embodiment are described, and description of common parts is omitted.

In the other embodiment, the temperature determining portion 51 compares the temperature detected by the temperature sensor 44 with the motor stop temperature T4 and determines whether or not the detected temperature is equal to or higher than the motor stop temperature T4. It is noted that the motor stop temperature T4 is a predetermined temperature that is set, in advance, in a range from being lower than the fixing temperature T1 to being equal to or higher than the motor rotation start temperature T3. The motor stop temperature T4 is 55° C., for example.

(Step S11)

Figure 5:
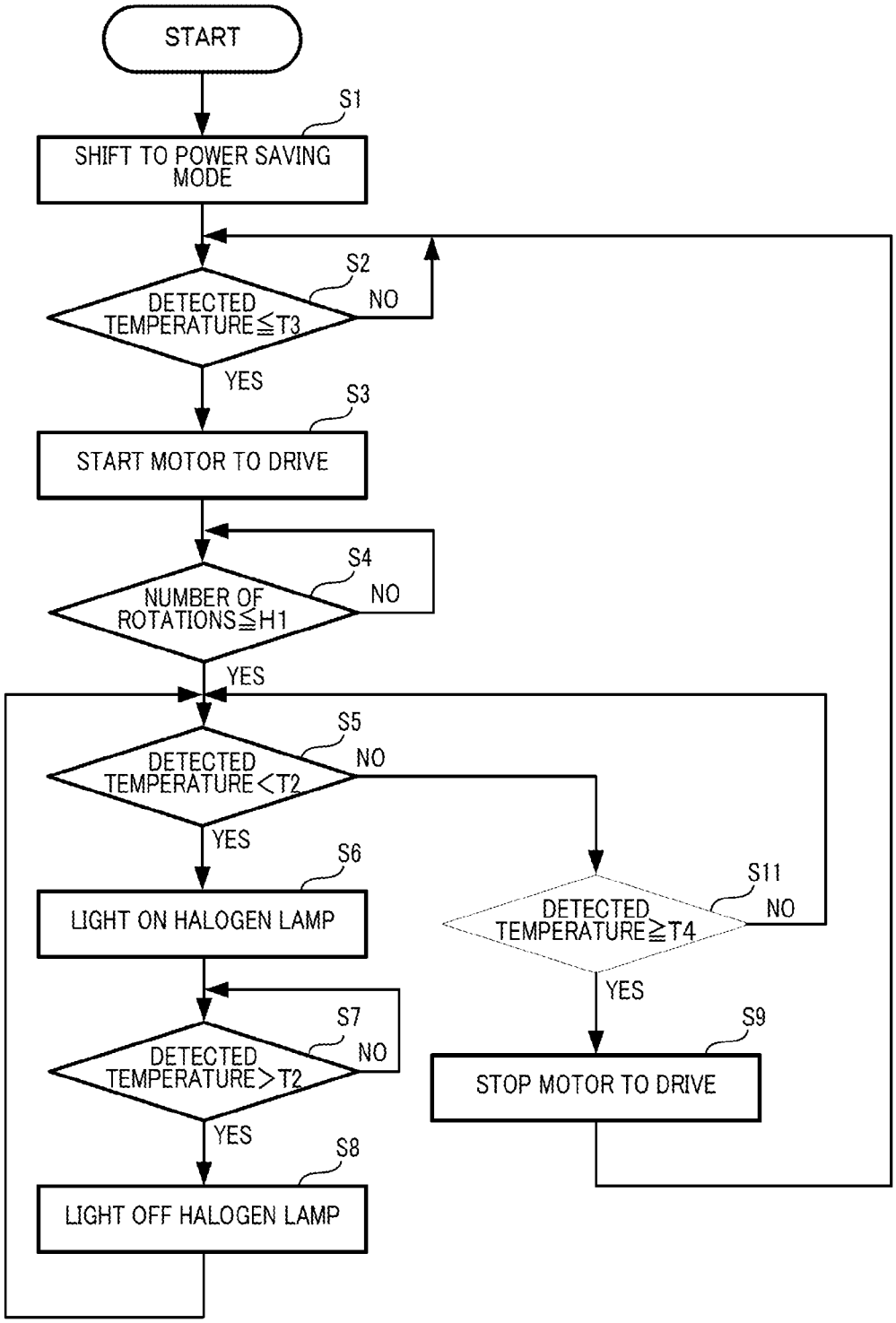
FIG. 5 is a flowchart showing another embodiment of the procedure of the temperature control process executed by the temperature control portion.

Upon determining, in step S5 of the temperature control process shown in FIG. 5, that the surface temperature of the fixing roller 41 is equal to or higher than the wait temperature T2 (NO side at S5), the process moves to step S11 in which the control portion 5 obtains the surface temperature of the fixing roller 41 detected by the temperature sensor 44, and determines whether or not the obtained surface temperature of the fixing roller 41 is equal to or higher than the motor stop temperature T4. Upon determining, in step S11, that the surface temperature of the fixing roller 41 is lower than the motor stop temperature T4 (NO side at S11), the control portion 5 moves the process to step S5. Accordingly, when the surface temperature of the fixing roller 41 is equal to or higher than the wait temperature T2 and lower than the motor stop temperature T4, the control portion 5 continues to control the driving motor 45 to rotate the fixing roller 41 and the pressure roller 42. On the other hand, upon determining that the surface temperature of the fixing roller 41 is equal to or higher than the motor stop temperature T4 (YES side at S11), the control portion 5 moves the process to step S9. Subsequently, in step S9, the control portion 5 stops the fixing roller 41 and the pressure roller 42 to be rotated, by stopping the driving motor 45 to drive.

As described above, the motor stop temperature T4 is set higher than the motor rotation start temperature T3 so that the driving motor 45 continues to drive when the surface temperature of the fixing roller 41 is equal to or higher than the wait temperature T2 and lower than the motor stop temperature T4. Here, if the motor stop temperature T4 is set close to the wait temperature T2, there is a possibility that the control portion 5 may repeatedly cause the driving motor 45 to drive and stop if the surface temperature of the fixing roller 41 is close to the wait temperature T2. In general, the driving motor 45 has such a characteristic that it consumes more power at the driving start than in the normal rotation where it continues to rotate at a constant speed. As a result, less power is consumed when the driving motor 45 continues to rotate than when the driving motor 45 stops for a short time. As described above, in the other embodiment, the determination is performed in step S11. This enables the control portion 5 to extend, with small power consumption, the time until the surface temperature of the fixing roller 41 falls to the wait temperature T2.

First Modification of Embodiment

Figure 6:
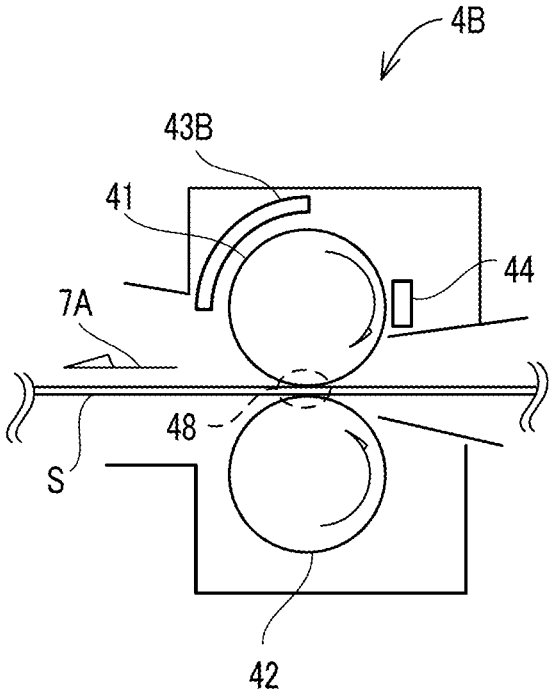
FIG. 6 is a diagram showing the configuration of the fixing device in the first modification.

In the above-described embodiments, the halogen lamp 43 is provided in the fixing roller 41 of the fixing device 4. However, the heating portion for heating the fixing roller 41 is not limited to the above-described example. For example, as shown in FIG. 6, a fixing device 4B provided with an IH coil 43B instead of the halogen lamp 43 is applicable, as well. The IH coil 43B is provided on the outer side of the fixing roller 41 in the fixing device 4B. The IH coil 43B inductively heats the surface of the fixing roller 41 formed in a roller shape. In general, the IH coil 43B can heat the fixing roller 41 in a shorter time and with smaller power consumption than the halogen lamp 43, and use of it can reduce the power consumption of the image forming apparatus 1.

Second Modification of Embodiment

Figure 7:
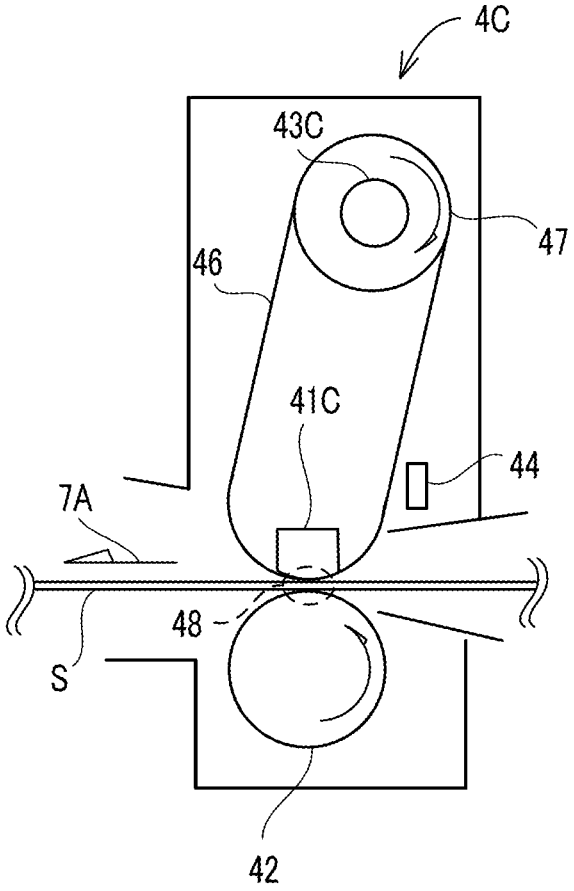
FIG. 7 is a diagram showing the configuration of the fixing device in the second modification.

In the above-described embodiments, the halogen lamp 43 is provided in the fixing roller 41 of the fixing device 4. However, the fixing device 4 is not limited to the above-described example. For example, as shown in FIG. 7, a fixing device 4C is applicable instead of the fixing device 4. Instead of the fixing roller 41 and the halogen lamp 43 in the fixing device 4, the fixing device 4C includes a heating roller 47, a halogen lamp 43C, a fixing belt 46 (an example of the heat conductor), and a pressure pad 41C (an example of the pressure portion). The halogen lamp 43C is provided in the heating roller 47, and heats the heating roller 47 from inside. The halogen lamp 43C uses a heating resistor such as a filament to heat the heating roller 47 from inside. The heating roller 47 conducts the heat, which is generated by the halogen lamp 43C, to the fixing belt 46. The fixing belt 46 is a rotatably supported endless belt, and is suspended between the heating roller 47 and the pressure pad 41C. The fixing belt 46 is heated by the halogen lamp 43C via the heating roller 47. The pressure pad 41C contacts the inner side of the fixing belt 46, and presses the fixing belt 46 against the pressure roller 42. It is noted that the pressure roller 42 is disposed to face the outer circumferential surface of the fixing belt 46. It is also noted that, in the second modification, the heating portion for heating the fixing belt 46 may be a heating portion that directly heats the fixing belt 46 by the inductive heating, instead of the halogen lamp 43C. In addition, the heating portion of the second modification may be a heating portion that heats the fixing belt 46 from outside, or a heating portion that heats the fixing belt 46 from inside.

Third Modification of Embodiment

Figure 8:
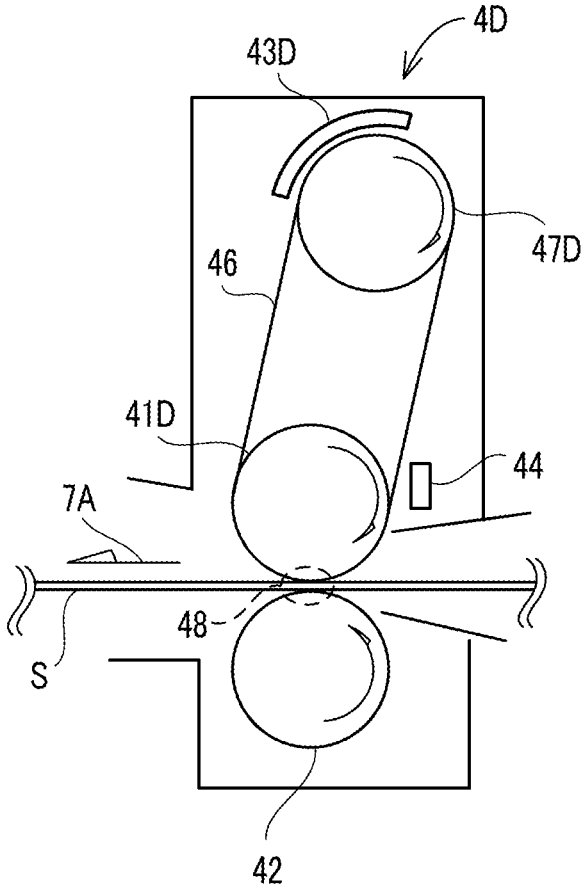
FIG. 8 is a diagram showing the configuration of the fixing device in the third modification.

In the above-described embodiments, the halogen lamp 43 is provided in the fixing roller 41 of the fixing device 4. However, the fixing device 4 is not limited to the above-described example. For example, as shown in FIG. 8, a fixing device 4D is applicable instead of the fixing device 4. Instead of the fixing roller 41 and the halogen lamp 43 in the fixing device 4, the fixing device 4D includes an IH coil 43D, a fixing belt 46, and a pulley 41D (an example of the pulley). The IH coil 43D heats the surface of the fixing belt 46 by the inductive heating. The fixing belt 46 is a rotatably supported endless belt, and is suspended between the heating roller 47 and the pulley 41D. The pulley 41D contacts the inner side of the fixing belt 46, and is rotated while pressing the fixing belt 46 against the pressure roller 42. It is noted that the pressure roller 42 is disposed to face the outer circumferential surface of the fixing belt 46. It is also noted that, in the third modification, the heating portion may use a halogen lamp, instead of the IH coil 43D, to heat the fixing belt 46 by the halogen lamp.

In the temperature control process of the above-described embodiments, in step S3, the control portion 5 starts the driving motor 45 to drive, and in step S9, stops the driving motor 45 to drive. However, the temperature control process is not limited to such a control. For example, upon determining, in step S4, that the number of rotations of the fixing roller 41 has reached the set rotation number H1, the control portion 5 may stop the driving motor 45 to drive.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a heat conductor rotatably supported and configured to conduct heat to a sheet to which a toner image has been transferred;

a heating portion configured to heat the heat conductor;

a pressure roller formed from a material having a larger heat capacity than the heat conductor, and configured to form a pressure contact portion by press-contacting the heat conductor and apply a pressure onto a sheet that passes through the pressure contact portion;

a driving portion configured to rotate either or both of the heat conductor and the pressure roller;

a temperature detecting portion configured to detect a surface temperature of the heat conductor;

a first temperature control portion configured to control temperature of the heat conductor in an image forming mode or a power saving mode, wherein in the image forming mode, the first temperature control portion controls, during an image forming period, the heating portion to maintain the heat conductor at a first temperature at which the toner image can be fixed to the sheet, and in the power saving mode, the first temperature control portion controls, during an image non-forming period, the heating portion to maintain the heat conductor at a second temperature which is lower than the first temperature; and a second temperature control portion configured to, upon determining that the temperature detected by the temperature detecting portion is equal to or lower than a third temperature when the first temperature control portion shifts from the image forming mode to the power saving mode, cause the driving portion to rotate the heat conductor at least once in a state where the heating portion has been stopped, the third temperature being set in advance in a range from being lower than the first temperature to being equal to or higher than the second temperature; wherein the second temperature control portion, after causing the driving portion to rotate the heat conductor at least once, determines whether or not the temperature detected by the temperature detecting portion is equal to or higher than a fourth temperature, and when the temperature detected by the temperature detecting portion is equal to or higher than the fourth temperature, stops the driving portion to drive, and when the temperature detected by the temperature detecting portion is lower than the fourth temperature, allows the driving portion to continue to rotate the heat conductor, the fourth temperature being set in advance in a range from being lower than the first temperature to being equal to or higher than the third temperature.

2. The image forming apparatus according to claim 1, wherein the second temperature control portion, after causing the driving portion to rotate the heat conductor at least once, determines whether or not the temperature detected by the temperature detecting portion is lower than the second temperature, and when the temperature detected by the temperature detecting portion is not lower than the second temperature, stops the driving portion to drive.

3. A temperature control method for use in a fixing device, the fixing device comprising:

a heat conductor heated by a heating portion, rotatably supported and configured to conduct heat to a sheet to which a toner image has been transferred;

a pressure roller formed from a material having a larger heat capacity than the heat conductor, and configured to form a pressure contact portion by press-contacting the heat conductor and apply a pressure onto a sheet that passes through the pressure contact portion; and a driving portion configured to rotate either or both of the heat conductor and the pressure roller, the temperature control method comprising:

a first step of, after an image forming mode has shifted to a power saving mode, determining whether or not a temperature detected by a temperature detecting portion is equal to or lower than a third temperature, wherein in the image forming mode, the heat conductor is maintained at a first temperature at which the toner image can be fixed to the sheet, and in the power saving mode, the heat conductor is maintained at a second temperature which is lower than the first temperature, the temperature detecting portion being configured to detect a surface temperature of the heat conductor, the third temperature being set in advance in a range from being lower than the first temperature to being equal to or higher than the second temperature;

a second step of, when the first step determines that the temperature detected by the temperature detecting portion is equal to or lower than the third temperature, rotating the heat conductor at least once in a state where the heating portion has been stopped;

a third step of, after causing the driving portion to rotate the heat conductor at least once, determining whether or not the temperature detected by the temperature detecting portion is equal to or higher than a fourth temperature;

a fourth step of, when the temperature detected by the temperature detecting portion is equal to or higher than the fourth temperature, stopping the driving portion to drive; and a fifth step of, when the temperature detected by the temperature detecting portion is lower than the fourth temperature, allowing the driving portion to continue to rotate the heat conductor, the fourth temperature being set in advance in a range from being lower than the first temperature to being equal to or higher than the third temperature.

4. A non-transitory computer-readable recording medium for controlling an image forming apparatus, the image forming apparatus comprising:

a heat conductor heated by a heating portion, rotatably supported and configured to conduct heat to a sheet to which a toner image has been transferred;

a pressure roller formed from a material having a larger heat capacity than the heat conductor, and configured to form a pressure contact portion by press-contacting the heat conductor and apply a pressure onto a sheet that passes through the pressure contact portion, a driving portion configured to rotate either or both of the heat conductor and the pressure roller; and a temperature detecting portion configured to detect a surface temperature of the heat conductor, the recording medium storing a program for causing a computer to execute:

a first step of, after an image forming mode has shifted to a power saving mode, determining whether or not a temperature detected by the temperature detecting portion is equal to or lower than a third temperature, wherein in the image forming mode, the heat conductor is maintained at a first temperature at which the toner image can be fixed to the sheet, and in the power saving mode, the heat conductor is maintained at a second temperature which is lower than the first temperature, the third temperature being set in advance in a range from being lower than the first temperature to being equal to or higher than the second temperature;

a second step of, when the first step determines that the temperature detected by the temperature detecting portion is equal to or lower than the third temperature, causing the driving portion to rotate the heat conductor at least once in a state where the heating portion has been stopped;

a third step of, after causing the driving portion to rotate the heat conductor at least once, determining whether or not the temperature detected by the temperature detecting portion is equal to or higher than a fourth temperature;

a fourth step of, when the temperature detected by the temperature detecting portion is equal to or higher than the fourth temperature, stopping the driving portion to drive; and a fifth step of, when the temperature detected by the temperature detecting portion is lower than the fourth temperature, allowing the driving portion to continue to rotate the heat conductor, the fourth temperature being set in advance in a range from being lower than the first temperature to being equal to or higher than the third temperature.

* * * * *